US007505120B2

(12) United States Patent
Ing-Song et al.

(10) Patent No.: US 7,505,120 B2
(45) Date of Patent: Mar. 17, 2009

(54) LASER RIFLESCOPE WITH ENHANCED DISPLAY BRIGHTNESS

(75) Inventors: Lin Ing-Song, Taichung (TW); Huang Jui-Chang, Taichung (TW)

(73) Assignee: Asia Optical Co., Inc, Taichung (TW)

( * ) Notice: Subject to any disclaimer, the term of this patent is extended or adjusted under 35 U.S.C. 154(b) by 146 days.

(21) Appl. No.: 11/230,576

(22) Filed: Sep. 21, 2005

(65) Prior Publication Data

US 2006/0221324 A1 Oct. 5, 2006

(30) Foreign Application Priority Data

Apr. 1, 2005 (TW) ..... 94110652 A

(51) Int. Cl.
*G01C 3/08* (2006.01)

(52) U.S. Cl. ..... 356/5.02; 356/4.01; 359/643; 359/399; 359/833

(58) Field of Classification Search ..... 356/5.02; 342/52–54, 58
See application file for complete search history.

(56) References Cited

U.S. PATENT DOCUMENTS

| | | | | |
|---|---|---|---|---|
| 4,081,813 | A * | 3/1978 | Kawamura et al. | 396/299 |
| 6,441,887 | B1 * | 8/2002 | Kao | 356/4.01 |
| 2004/0184023 | A1 * | 9/2004 | Kao | 356/4.01 |
| 2005/0219690 | A1 * | 10/2005 | Lin et al. | 359/429 |
| 2005/0252062 | A1 * | 11/2005 | Scrogin et al. | 42/119 |
| 2006/0039065 | A1 * | 2/2006 | Dunne | 359/399 |

* cited by examiner

*Primary Examiner*—Thomas H Tarcza
*Assistant Examiner*—Timothy A Brainard

(57) ABSTRACT

A laser riflescope includes a laser emitter, a laser receiver, an objective lens group (11) for collecting the visible light from the target to be measured, an eyepiece group (14) adapted for observation by the user of the distance information of the target and defining an optical axis with the objective lens group, a prism group (12) disposed between the objective lens group and the eyepiece group for light beam transmission, and a display element (13) for displaying the distance information of the target. The display element is an OLED having high transmittance to enhance the display brightness of the laser riflescope.

14 Claims, 2 Drawing Sheets

LASER RIFLESCOPE WITH ENHANCED DISPLAY BRIGHTNESS

BACKGROUND OF THE INVENTION

1. Field of the Invention

The present invention generally relates to a range measuring device, and more particularly relates to a laser riflescope with enhanced display brightness.

2. Description of Prior Art

A laser riflescope generally includes a laser emitter, a laser receiver, and a telescope system. The laser emitter is adapted for transmitting an invisible laser light beam to a target to be measured. The target reflects and returns the laser light beam to the laser receiver, which is commonly an avalanche photo diode (APD) to convert the optical signal into an electric signal. The distance between the laser riflescope and the target is calculated according to the time interval between the emission and reception of the laser light beam. The telescope system, which is used for the user to identify and aim at the target, generally includes an objective lens group, an eyepiece group, and a prism group arranged between the objective lens group and the eyepiece group. However, in practical use, if the laser emitter, the laser receiver, and the telescope system, each of which is composed of several lenses, have their respective optical axes, the volume of the laser riflescope will be significantly increased. Furthermore, this will also lead to a poor range measurement precision since the path of the invisible laser light beam for range measurement and the path of visible light beam for observation of the user are spaced from each other.

To address the above problems, U.S. Pat. No. 6,441,887, which is assigned to the same assignee as the present invention, provides a solution as illustrated in FIG. 1. The laser riflescope 90 as disclosed by the '887 patent includes an observation/emitting optical system 91 and a receiving optical system 92. The observation/emitting optical system 91 includes an objective lens group 93, a prism group 94, a laser emitter 95, a display 96, and an eyepiece group 97. The receiving optical system 92 includes a laser receiver 98 and a prism 99. By the reflection and refraction of the prism group 94, the traveling paths of the invisible laser light beam for measurement and the visible light beam for observation are combined between the objective lens group 93 and the prism group 94. As a result, the volume of the laser riflescope 90 can be greatly reduced. Further, the measurement precision of the laser riflescope 90 is also ensured since the observation point and the measured point is the same.

The display 96 of the laser riflescope 90 is a transmissive LCD (Liquid Crystal Display) positioned within the field of view of the laser riflescope 90 for displaying the distance information of the target. After the visible light beam from the target enters into the observation/emitting optical system 91 and is transmitted through a number of lenses, the visible light beam then must penetrate through the transmissive LCD 96 for the distance information to be visible by the user. However, in this penetrating course, light loss occurs, which may reduce light output by as much as 50% and thus the display effect of the distance information. Especially, when measurement is conducted under dim lighting conditions, only a small amount of light enters into the observation/emitting optical system 91, and therefore, the distance information displayed by the LCD 96 becomes unreadable or even cannot be displayed.

Another distance information displaying method is also applied in the conventional laser riflescopes. As shown in FIG. 2, a conventional observation/emitting optical system 80 for a laser riflescope includes an objective lens group 81, a prism group 82, a laser emitter 83, a display 84, and an eyepiece group 85. The display 84 is generally an LED (Light Emitting Diode) for emitting a light beam of a narrow wavelength. This light beam is first reflected by a reflector 86, transmitted through a lens group 87, enters into the prism group 82 and is finally imaged in the field of view 88 of the laser riflescope. It is clear that, the problem of light loss still exists since the light beam is transmitted through a relatively long optical path, which leads to insufficient brightness of the displayed distance information.

Hence, a laser riflescope with enhanced brightness is desired to overcome the above-mentioned problems in the prior art.

SUMMARY OF THE INVENTION

Accordingly, the object of the present invention is to provide a laser riflescope having an optical system with increased light transmittance so as to enhance the display brightness of the target distance information.

To achieve the above object of the present invention, a laser riflescope in accordance with the present invention has an observation optical system comprising an objective lens group for receiving visible light from the target, an eyepiece group adapted for observation by the user of the target image and distance information and defining an optical axis of the observation optical system with the objective lens group, a prism group disposed between the objective lens group and the eyepiece group for transmitting the visible light beam from the objective lens group to the eyepiece group, and a display element for displaying the distance information of the target. The display element has high transmittance and is disposed on the optical axis of the observation optical system to enhance the display brightness of the laser riflescope.

The display element is an OLED (Organic Light Emitting Diode) positioned between the prism group and the eyepiece group.

The prism group includes a front prism for receiving the visible light beam from the objective lens group, a rear prism for transmitting the visible light beam to the eyepiece group, and an auxiliary prism.

The laser riflescope further comprises a laser emitting optical system and a laser receiving optical system. The laser emitting optical system can be combined with the observation optical system to form an observation/emitting optical system. The observation/emitting optical system at least includes a laser emitter for emitting an invisible laser light beam that is reflected and refracted by the prism group and then projected by the eyepiece group.

The laser receiving optical system can be combined with the observation optical system to form an observation/receiving optical system. The observation/receiving optical system at least includes a laser receiver. The laser light beam reflected back from the target is first transmitted through the objective lens group, then is reflected and refracted by the prism group, and finally is received by the laser receiver for distance calculation.

BRIEF DESCRIPTION OF THE DRAWINGS

The present invention may best be understood through the following description with reference to the accompanying drawings, in which.

DETAILED DESCRIPTION OF THE INVENTION

Figure 3:
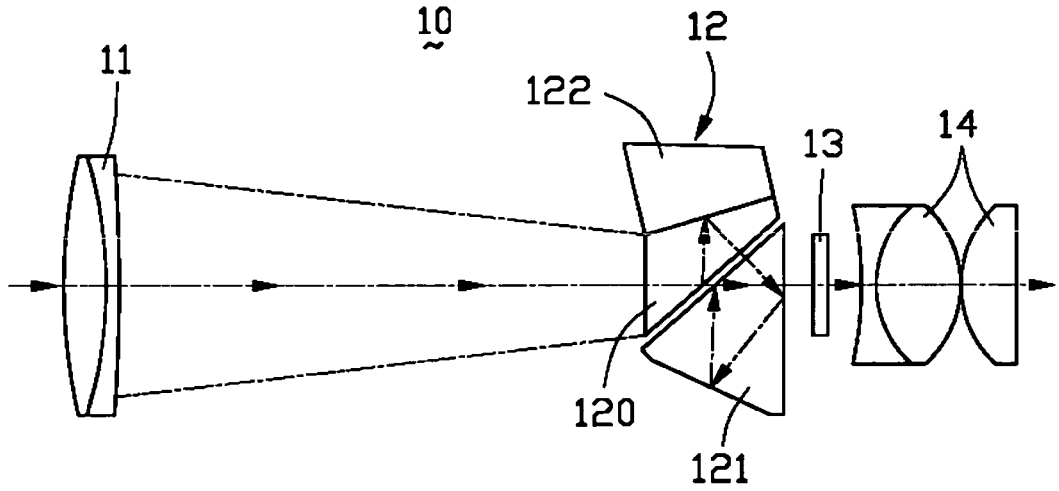
FIG. 3 is a cross-sectional view of the observation optical system of a laser riflescope in accordance with the present invention.

Referring to FIG. 3, a laser riflescope in accordance with the present invention has an observation optical system 10 including an objective lens group 11, a prism group 12, a display element 13, and an eyepiece group 14. The objective lens group 11 is adapted to collect visible light coming from the target to be measured and aimed at. The eyepiece group 14 is used for observation of the target image by the user and defines an optical axis of the observation optical system 10 with the objective lens group 11. The prism group 12 is adapted to transmit the visible light beam from the objective lens group 11 to the eyepiece group 14. The prism group 12 includes a front prism 120 for receiving the visible light beam from the objective lens group 11, a rear prism 122 for transmitting the visible light beam to the eyepiece group 14, and an auxiliary prism 122. The display element 13 is disposed in the field of view between the prism group 12 and the eyepiece group 14 for displaying the distance information of the target.

In the present invention, the display element 13 is in the form of an OLED (Organic Light Emitting Diode) having high transmittance. The OLED is disposed on the optical axis of the observation optical system 10, whereby the visible light beam from the target can be easily transmitted through the display element 13 and thus the distance information of the target can be clearly displayed on the display element 13. Accordingly, the problem of insufficient display brightness of the target distance information can be addressed by the present invention.

Figure 1:
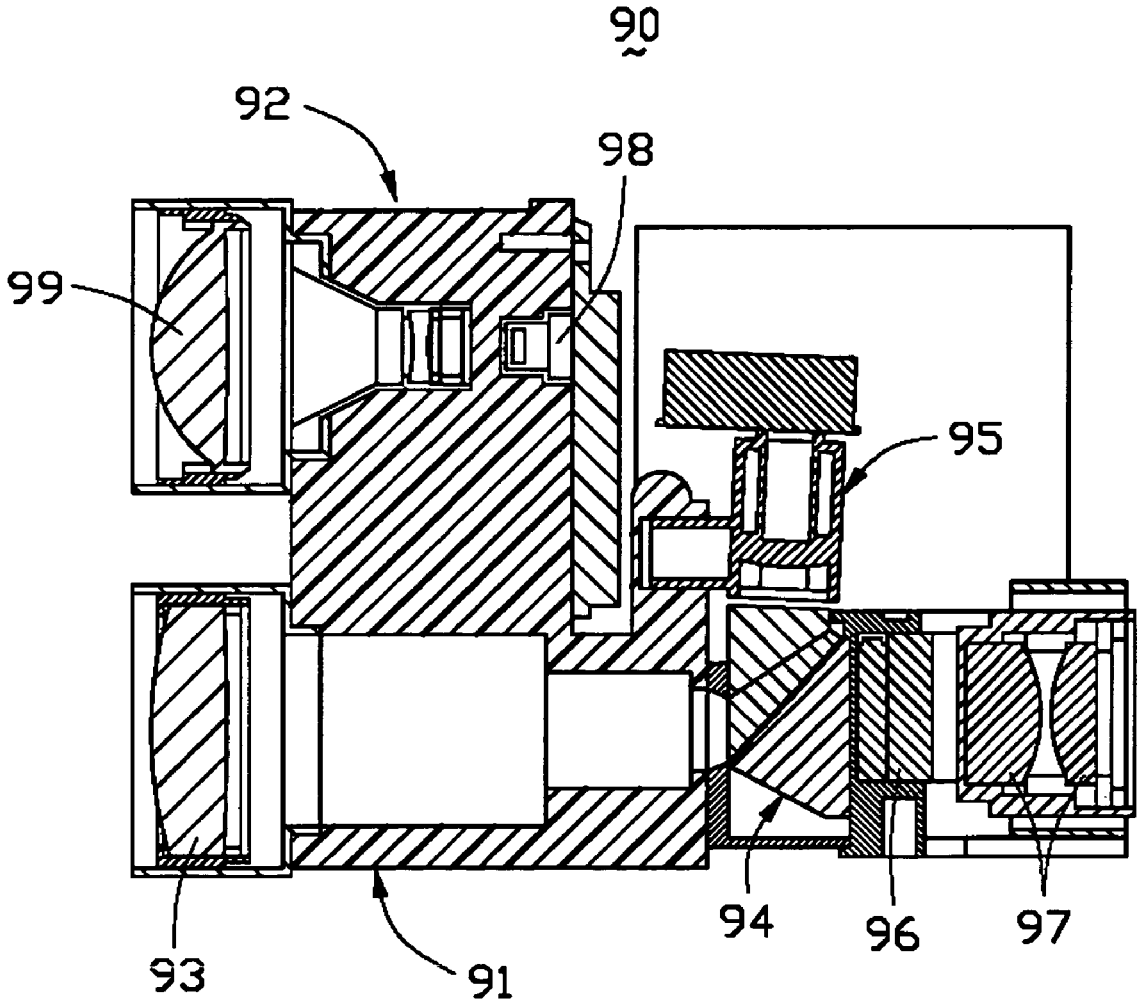
FIG. 1 (Prior Art)
FIG. 1 is a cross-sectional view of a conventional laser riflescope.
Figure 2:
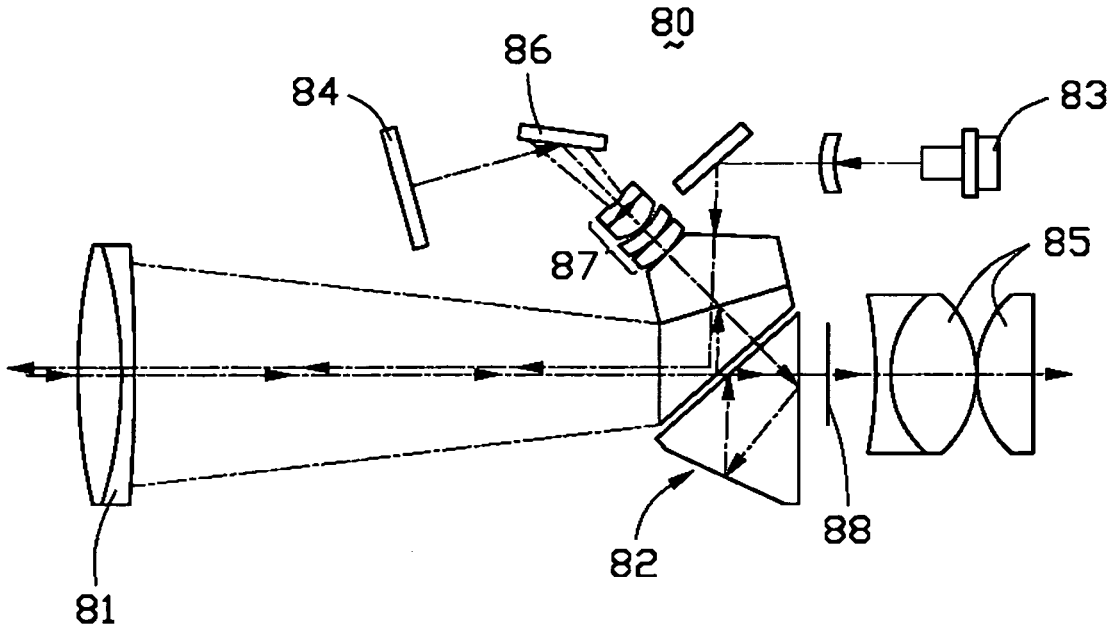
FIG. 2 (Prior Art)
FIG. 2 is a cross-sectional view of the observation/emitting optical system of another conventional laser riflescope.

The observation optical system 10 of the laser riflescope further includes a laser emitting optical system and a laser receiving optical system. The laser emitting optical system includes a laser emitter and can be combined with the observation optical system 10 to form an observation/emitting optical system. The laser beam emitted by the laser emitter is reflected and refracted by the prism group 12 and is then projected by the eyepiece group 11. Detailed incorporation method can refer to the observation/emitting optical system 91 in FIG. 1. The laser receiving optical system includes a laser receiver and can be an individual optical system for receiving the laser beam. An example of such an individual receiving optical system is disclosed in FIG. 1 (the receiving optical system 92). The disclosure of U.S. Pat. No. 6,441,887 is incorporated herein by reference for a full understanding of the present invention.

It should be understood that the range measuring function of the present laser riflescope can be performed in other manners. For example, the laser emitting optical system can be designed as an individual optical system, while the laser receiving optical system can be combined with the observation optical system 10 to form an observation/receiving optical system. Since the laser emitting optical system, the laser receiving optical system, and the range measuring technology are all disclosed in the prior art and are not the essential part of the present invention, a detailed description thereof is omitted.

By disposing an OLED having high transmittance in the field of view of the observation optical system 10 of the present laser riflescope, visible light transmittance is significantly increased and thus the display brightness of the target distance information is enhanced.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A range measuring device having an observation optical system, the observation optical system comprising:

an objective lens element collecting the visible light from the target to be measured;

an eyepiece element adapted for observation by the user of the image and distance information of the target, the eyepiece element defining an optical axis with the objective lens element;

a prism element disposed between the objective lens element and the eyepiece element for transmitting the visible light beam from the objective lens element to the eyepiece element; and a display element displaying the distance information of the target, the display element being in the form of an organic light emitting diode having high light transmittance to enhance the display brightness of the range measuring device, the display element being disposed between the prism element and the eyepiece element and being in alignment with the prism element and the eyepiece element along the optical axis.

2. The range measuring device as claimed in claim 1, wherein the prism element includes a front prism for receiving the visible light beam from the objective lens element, a rear prism for transmitting the visible light beam to the eyepiece element, and an auxiliary prism.

3. The range measuring device as claimed in claim 1, further comprising a laser emitting optical system and a laser receiving optical system.

4. The range measuring device as claimed in claim 3, wherein the laser emitting optical system is combined with the observation optical system to form an observation/emitting optical system.

5. The range measuring device as claimed in claim 4, wherein the laser emitting optical system includes a laser emitter emitting a laser beam, the laser beam being first reflected and refracted by the prism element and then projected by the eyepiece element.

6. The range measuring device as claimed in claim 3, wherein the laser receiving optical system is combined with the observation optical system to form an observation/receiving optical system.

7. The range measuring device as claimed in claim 6, wherein the laser receiving optical system includes a laser receiver, the laser receiver receiving the returned laser beam from the target for distance calculation.

8. A range measuring device comprising:

a light emitter emitting an invisible light beam to the target to be measured;

a light receiver receiving the invisible light beam returned back from the target;

an objective lens element disposed proximate to the target end;

an eyepiece element disposed proximate to the observation end for observation by the user of the distance information of the target, the eyepiece element defining an optical axis with the objective lens element;

a prism element disposed between the objective lens element and the eyepiece element for light beam transmission; and a display element being disposed on the optical axis and displaying the distance information of the target, the display element being in the form of an organic light emitting diode having high light transmittance to enhance the display brightness of the range measuring device, the display element being disposed between the prism element and the eyepiece element and being in alignment with the prism element and the eyepiece element along the optical axis.

9. The range measuring device as claimed in claim 8, wherein the prism element includes a front prism for receiving the light beam from the objective lens element, a rear prism for transmitting the light beam to the eyepiece element, and an auxiliary prism.

10. The range measuring device as claimed in claim 9, wherein the invisible light beam emitted by the light emitter is projected to the target via the objective lens element.

11. The range measuring device as claimed in claim 9, wherein the invisible light beam returned from the target is received by the light receiver after being sequentially transmitted through the objective lens element and the prism element.

12. A laser riflescope comprising:

a laser emitter emitting a laser beam to the target to be measured and aimed at;

a laser receiver receiving the laser beam returned back from the target;

an objective lens element disposed proximate to the target end;

an eyepiece element disposed proximate to the observation end for observation by the user of the distance information of the target, the eyepiece element defining an optical axis with the objective lens element;

a prism element including a front prism for receiving the light beam from the objective lens element, a rear prism for transmitting the light beam to the eyepiece element, and an auxiliary prism; and a display element being disposed on the optical axis and displaying the distance information of the target, the display element being in the form of an organic light emitting diode having high light transmittance to enhance the display brightness of the laser riflescope, the display element being disposed between the prism element and the eyepiece element and being in alignment with the prism element and the eyepiece element along the optical axis.

13. The laser riflescope as claimed in claim 12, wherein the laser beam emitted by the laser emitter is projected to the target sequentially through the prism element and the objective lens element.

14. The laser riflescope as claimed in claim 12, wherein the laser beam returned from the target is received by the light receiver after being sequentially transmitted through the objective lens element and the prism element.

* * * * *